US012521780B2

(12) United States Patent
Fujii et al.

(10) Patent No.: US 12,521,780 B2
(45) Date of Patent: Jan. 13, 2026

(54) PRESS FORMING PART

(71) Applicant: JFE STEEL CORPORATION, Tokyo (JP)

(72) Inventors: Yusuke Fujii, Tokyo (JP); Masaki Urabe, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 223 days.

(21) Appl. No.: 18/036,298

(22) PCT Filed: Jul. 2, 2021

(86) PCT No.: PCT/JP2021/025073
§ 371 (c)(1),
(2) Date: May 10, 2023

(87) PCT Pub. No.: WO2022/113413
PCT Pub. Date: Jun. 2, 2022

(65) Prior Publication Data

US 2023/0415215 A1 Dec. 28, 2023

(30) Foreign Application Priority Data

Nov. 25, 2020 (JP) ..... 2020-194886

(51) Int. Cl.
*B21D 22/26* (2006.01)

(52) U.S. Cl.
CPC ..... *B21D 22/26* (2013.01)

(58) Field of Classification Search
CPC ..... B21D 22/26; B21D 22/20; B31D 22/26
See application file for complete search history.

(56) References Cited

U.S. PATENT DOCUMENTS

| | | | |
|---|---|---|---|
| 2012/0297853 | A1 | 11/2012 | Tanaka et al. |
| 2013/0239645 | A1 | 9/2013 | Tanaka et al. |
| 2015/0336619 | A1 | 11/2015 | Tanaka et al. |
| 2016/0082495 | A1 | 3/2016 | Miyagi et al. |
| 2017/0291208 | A1 | 10/2017 | Nishimura et al. |
| 2018/0085811 | A1 | 3/2018 | Fujii et al. |
| 2019/0030583 | A1 | 1/2019 | Nishimura et al. |

(Continued)

FOREIGN PATENT DOCUMENTS

| | | | |
|---|---|---|---|
| CN | 107405668 | A | 11/2017 |
| EP | 2 644 293 | A1 | 10/2013 |
| EP | 2 942 123 | A1 | 11/2015 |

(Continued)

OTHER PUBLICATIONS

English translation of JP5020858B2 obtained form USPTO Fit database Apr. 16, 2025 (Year: 2025).*

(Continued)

*Primary Examiner* — Adam Krupicka
(74) *Attorney, Agent, or Firm* — Oliff PLC

(57) ABSTRACT

A press forming part includes: a top portion; a side wall portion continuous from the top portion via a punch shoulder; and a flange portion continuous from the side wall portion via a die shoulder, the press forming part having a curved portion curved in a recessed manner in a top view, wherein a bending radius of the die shoulder in the curved portion is increased from an end side toward a middle portion of the curve.

17 Claims, 5 Drawing Sheets

(a) PERSPECTIVE VIEW (b) TOP VIEW

(56) References Cited

U.S. PATENT DOCUMENTS

2020/0346267 A1 11/2020 Otsuka et al.

FOREIGN PATENT DOCUMENTS

| | | | | |
|---|---|---|---|---|
| JP | H01-143626 | U | | 10/1989 |
| JP | 2009-202189 | A | | 9/2009 |
| JP | 2010064138 | A | | 3/2010 |
| JP | 5020858 | B2 | * | 9/2012 |
| JP | 5168429 | B2 | | 3/2013 |
| JP | 5836972 | B2 | | 12/2015 |
| JP | 6028956 | B1 | | 11/2016 |
| JP | 2019-171440 | A | | 10/2019 |
| JP | 6897841 | B1 | | 7/2021 |
| WO | 2014/106932 | A1 | | 7/2014 |
| WO | 2017/002253 | A1 | | 1/2017 |

OTHER PUBLICATIONS

Aug. 31, 2023 Extended Search Report issued in European Patent Application No. 21897393.1.

Aug. 10, 2021 International Search Report issued in International Patent Application No. PCT/JP2021/025073.

Aug. 10, 2021 Written Opinion issued in International Patent Application No. PCT/JP2021/025073.

May 30, 2023 International Preliminary Report on Patentability issued in International Patent Application No. PCT/JP2021/025073.

Sep. 7, 2021 Search Report issued in International Patent Application No. PCT/JP2021/024791.

Sep. 7, 2021 Written Opinion of the International Searching Authority issued in International Patent Application No. PCT/JP2021/024791.

Aug. 31, 2023 Extended Search Report issued in European Patent Applcation No. 21897392.3.

Dec. 19, 2024 U.S. Office Action issued in U.S. Appl. No. 18/033,704.

Mar. 22, 2025 Office Action issued in Chinese Patent Application No. 202180079083.6.

May 27, 2025 U.S. Office Action issued in U.S. Appl. No. 18/033,704.

Sep. 11, 2025 U.S. Office Action issued in U.S. Appl. No. 18/033,704.

U.S. Appl. No. 18/033,704, filed Apr. 25, 2023 in the name of Yusuke Fujii et al.

Jun. 17, 2025 Office Action issued in Korean Patent Application No. 10-2023-7016888 (with concise explanation of relevance in English.

* cited by examiner

PRESS FORMING PART

FIELD

The present invention relates to a press forming part, and more specifically relates to a press forming part that includes a top portion, a side wall portion continuous from the top portion via a punch shoulder, and a flange portion continuous from the side wall portion via a die shoulder, the press forming part having a curved portion curved in a recessed manner in a top view.

BACKGROUND

Press forming is a manufacturing method capable of manufacturing metal parts at a low cost in a short time, and is used for manufacturing of many automotive parts. In recent years, in order to achieve both improvement in collision safety of an automobile and weight reduction of an automotive body, a metal sheet having higher strength is used for automotive parts. Main problems in press forming of a high-strength metal sheet include generation of a fracture due to a decrease in ductility and generation of wrinkles due to an increase in yield strength.

For example, in press forming of bringing a press forming part 101 in which a side wall portion 107 is curved in a recessed manner in a top view as illustrated in FIG. 7 into a target shape, a flange portion 111 in a curved portion 113 is pulled in a circumferential direction and a fracture is likely to be generated. In addition, when a shrink deformation in the circumferential direction is generated as reaction force in a top portion 103 and a punch shoulder 105 in the curved portion 113, wrinkles are likely to be generated. This deformation is called stretch flange deformation. Thus, in the press forming part 101, it is important to control generation of the fracture and wrinkles in a process of the stretch flange deformation.

Several technologies of controlling a fracture and wrinkles of a press forming part curved in a recessed manner in a top view have been proposed to date. For example, Patent Literature 1 discloses a technology of press forming, from a sheet metal blank, an L-shaped part including a top portion and a side wall portion that is connected to the top portion via a bent portion having a portion curved in an arc shape and that has a flange portion on an opposite side of the bent portion. According to Patent Literature 1, a portion of the sheet metal blank which portion corresponds to the top portion is pressed by a pad, an end of a portion of the sheet metal blank which portion corresponds to an L-shaped lower portion of the L-shaped part is allowed to slide (movement in a plane), and the portion corresponding to the L-shaped lower portion is pulled toward a side of the side wall portion, whereby the side wall portion and the flange portion are formed. Thus, it is possible to acquire the L-shaped part in which generation of a fracture in the flange portion and generation of wrinkles in the top portion are controlled.

In addition, Patent Literature 2 discloses a technology of press forming a part having a hat-shaped or U-shaped cross section shape and having a curved portion curved in a longitudinal direction and straight side portions connected to both ends of the curved portion. According to Patent Literature 2, it is assumed that it is possible to acquire a part in which generation of a fracture due to a stretch flange deformation is controlled by generation of a material movement that relaxes a tensile deformation in a circumferential direction which deformation is generated in a flange portion of the curved portion.

CITATION LIST

Patent Literature

Patent Literature 1: Japanese Patent No. 5168429
Patent Literature 2: Japanese Patent No. 6028956

SUMMARY

Technical Problem

In the technology disclosed in Patent Literature 1, as illustrated in FIG. 8, a moving direction of a material of a blank (metal sheet) flowing out from a top portion 103 to a side of the flange portion 111 does not coincide with a direction in which the material is pulled by the stretch flange deformation (dotted arrow in the circumferential direction in the flange portion 111). When the material movement of the blank is resolved into vectors in two directions as illustrated in FIG. 9, although a movement from an end side of the curved portion 113 toward a middle portion (solid black arrow in the drawing) is effective for controlling the fracture of the flange portion 111 due to the stretch flange deformation, a movement from the top portion 103 toward the side wall portion 107 (broken black arrow in the drawing) does not contribute to the controlling of the stretch flange deformation. Furthermore, even when the material moves toward the middle portion of the curved portion 113, a material movement in the vicinity of the middle portion of the curved portion 113 (white arrow in the drawing) may induce wrinkles in the vicinity of the top portion 103 and the punch shoulder 105.

In addition, the technology disclosed in Patent Literature 1 is to control wrinkles of a top portion by pressurizing a portion corresponding to the top portion in a sheet metal blank with a pad. However, a high-strength steel sheet requires an increase in a pad load for pressurizing the wrinkles. Thus, there is a concern that a pressure generator such as a gas cylinder installed in a tool of press forming becomes huge. As a result, there are a problem that there is a case where a space for installing the pad cannot be secured in the tool of press forming, and a problem of an increase in a cost due to an increase in a size of the tool of press forming. Furthermore, in a case where the technology of Patent Literature 1 is applied to press forming of the press forming part 101 illustrated in FIG. 7, since the punch shoulder 105 cannot be pressurized with the pad, wrinkles at the punch shoulder 105 are not controlled.

In addition, the technology disclosed in Patent Literature 2 is to control wrinkles by moving a material of a top surface of a curved portion in a direction of becoming away from a flange, in which a stretch flange deformation is generated, by draw forming. However, application to a part shape in which such a material movement cannot be performed, or a part manufactured by crash forming is not possible.

Furthermore, in both Patent Literature 1 and Patent Literature 2, for example, in a press forming part in which it is necessary to give a bead shape to a top portion 103 in a curved portion 113 or in the vicinity thereof, there is a case where a material of a portion corresponding to a top portion 103 in a curved portion 113 illustrated in FIG. 9 cannot be moved to a flange portion 111 where a stretch flange deformation is generated. This makes it difficult to control the wrinkles and is a problem.

The present invention has been made to solve the above-described problems, and an object thereof is to provide a press forming part which has a top portion, a side wall portion, and a flange portion and is curved in a recessed manner in a top view, and in which a fracture in the flange portion where a stretch flange deformation is generated is controlled and wrinkles of the top portion on a side of the flange portion and a punch shoulder are controlled.

Solution to Problem

To solve the problem and achieve the object, a press forming part according to the present invention includes: a top portion; a side wall portion continuous from the top portion via a punch shoulder; and a flange portion continuous from the side wall portion via a die shoulder, the press forming part having a curved portion curved in a recessed manner in a top view, wherein a bending radius of the die shoulder in the curved portion is increased from an end side toward a middle portion of the curve.

Moreover, in the press forming part according to the present invention, a minimum bending radius of the die shoulder is smaller than a bending radius of the punch shoulder.

Moreover, in the press forming part according to the present invention, a portion of shape that restrains rotational motion, which restrains a rotational motion of a blank in a press forming process, is formed on the top portion on the end side of the curve.

Moreover, in the press forming part according to the present invention, a width of the flange portion in the curved portion is larger in the middle portion than on the end side of the curve.

Moreover, in the press forming part according to the present invention, the press forming is performed by utilization of a metal sheet having tensile strength of a 440 MPa-grade to a 1600 MPa-grade.

Advantageous Effects of Invention

In the present invention, a top portion, a side wall portion continuous from the top portion via a punch shoulder, and a flange portion continuous from the side wall portion via a die shoulder are included, a curved portion curved in a recessed manner in a top view is included, and a bending radius of the die shoulder in the curved portion is increased from an end side toward a middle portion of the curve. Thus, since it is possible to move a material from the top portion on the end side of the curve toward the flange portion in the middle portion of the curve in a press forming process, a fracture in the flange portion of the curved portion is controlled, and wrinkles of the top portion on a side of the flange portion and the punch shoulder in the curved portion are controlled.

DESCRIPTION OF EMBODIMENTS

A press forming part according to an embodiment of the present invention will be described below with reference to FIG. 1 to FIG. 6.

Figure 1:
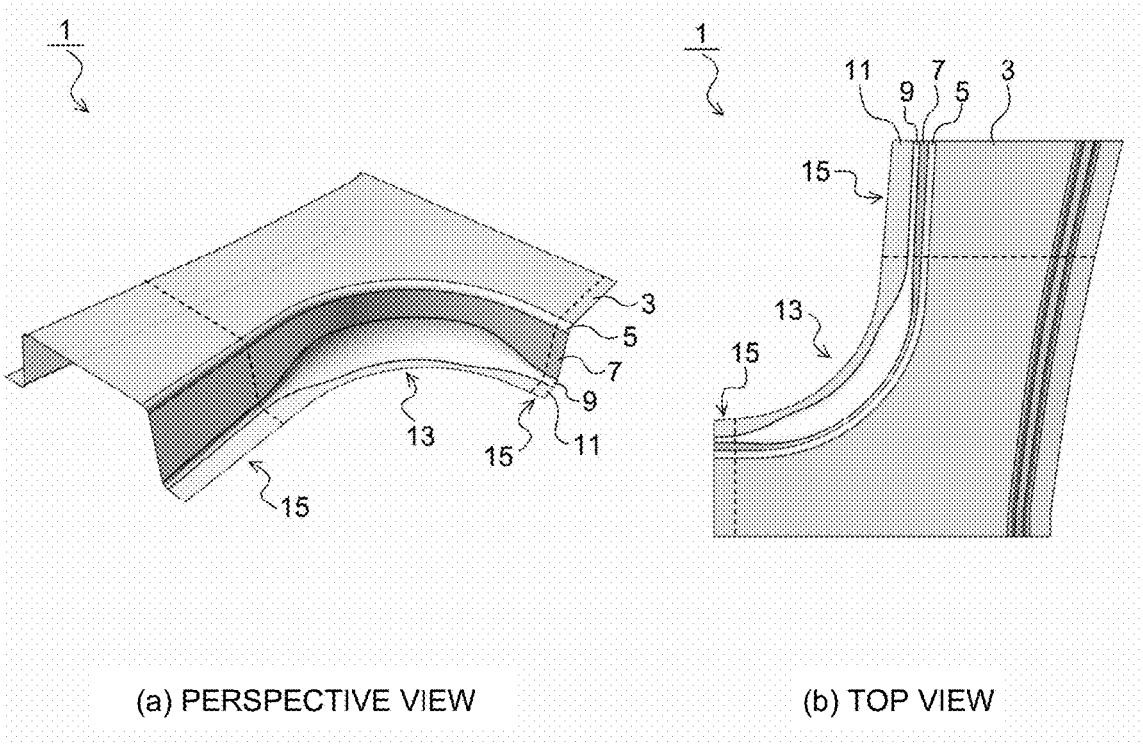
FIG. 1 is a view illustrating an example of a press forming part according to an embodiment of the present invention ((a) perspective view, and (b) top view).

As illustrated in FIG. 1 as an example, a press forming part 1 according to the present embodiment includes a top portion 3, a side wall portion 7 continuous from the top portion 3 via a punch shoulder 5, and a flange portion 11 continuous from the side wall portion 7 via a die shoulder 9, and has a curved portion 13 curved in a recessed manner in a top view, and straight portions 15 extending linearly from both ends of the curve in the curved portion 13 (broken line in FIG. 1). A bending radius of the die shoulder 9 in the curved portion 13 is increased from end sides toward a middle portion of the curve.

Figure 2:
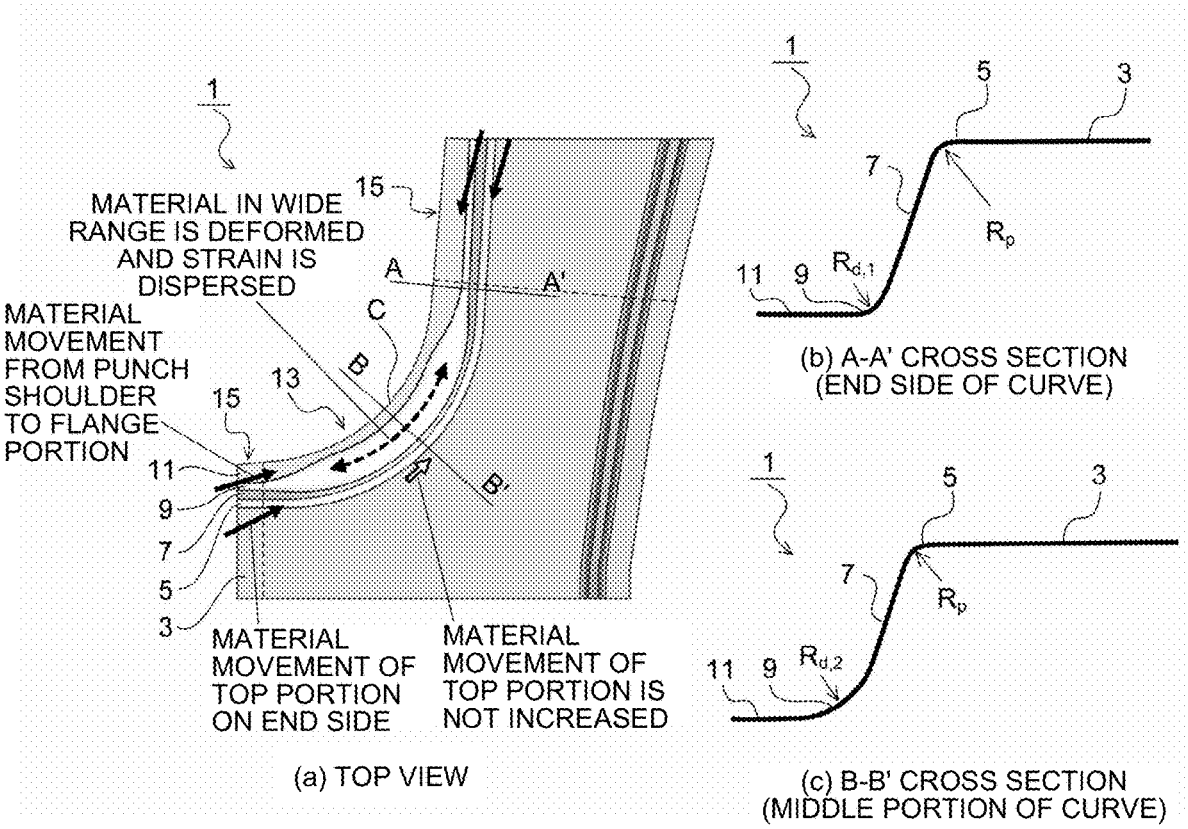
FIG. 2 is a view for describing a reason why a fracture and wrinkles are controlled in a press forming process of the press forming part according to the embodiment of the present invention ((a) top view, (b) cross-sectional view of an end side of a curve, and (c) cross-sectional view of a middle portion of the curve).

A reason why both a fracture of the flange portion 11 and wrinkles of the top portion 3 and the punch shoulder 5 in the curved portion 13 are controlled in a press forming process of the press forming part 1 will be described with reference to FIG. 2 schematically illustrating a movement of a material in the press forming process. Note that broken lines in FIG. 2 indicate both ends of the curve (boundaries between the curved portion 13 and the straight portions 15).

The die shoulder 9 is increased from the end sides toward the middle portion of the curve in such a manner that a bending radius Rd,2 (FIG. 2(*c*)) in the middle portion of the curve (B-B' cross section) is larger than a bending radius Rd,1 (FIG. 2(*b*)) on the end sides of the curve (A-A' cross section). Thus, at the die shoulder 9 in the middle portion of the curved portion 13, since the material can be easily moved in the press forming process, a stretch flange deformation is generated in a wide range, and a strain is dispersed (black broken line arrow in FIG. 2(*a*)).

On the other hand, since the bending radius of the die shoulder 9 is smaller on the end sides of the curve than in the middle portion of the curve, in a process of press forming the end sides of the curve by using a punch and a die, a material deformed by an abutment on the die shoulder of the die is less likely to move on the die shoulder, whereby force of pulling the material from the top portion 3 toward the side of the flange portion 11 is increased. At the same time, the material is pulled from the end sides toward the middle portion of the curve in a process of press forming the middle portion of the curve. Thus, the material movement from the top portion 3 and the punch shoulder 5 on the end sides of the curve toward the flange portion 11 in the middle portion of the curve is increased (solid black arrow in FIG. 2(*a*)).

As described above, the stretch flange deformation is generated in a wide range in the middle portion of the curve, the strain is dispersed, and the material movement from the end sides of the curve toward the flange portion 11 is increased, whereby the fracture of the flange portion 11 is controlled.

Furthermore, since the bending radius of the die shoulder 9 in the middle portion of the curve is large, the large material movement toward the middle of the curve in the top portion 3 in the vicinity of the middle portion of the curve (white arrow in FIG. 2(*a*)) becomes small, and generation of wrinkles are controlled in the top portion 3 on the side of the flange portion 11 and the punch shoulder in the middle portion of the curve.

From the above, in the press forming part 1 according to the present embodiment, both the fracture of the flange portion 11 and the wrinkles of the top portion 3 and the punch shoulder 5 in the curved portion 13 are controlled.

Furthermore, in the press forming part 1 according to the present embodiment, the minimum bending radius of the die shoulder 9 is preferably smaller than the bending radius of the punch shoulder 5.

Here, the minimum bending radius of the die shoulder 9 is the smallest bending radius of the die shoulder 9 in the curved portion 13. In the press forming part 1, as illustrated in FIG. 2, since the bending radius of the die shoulder 9 is increased from the end sides toward the middle portion of the curve, the minimum bending radius of the die shoulder 9 is the bending radius Rd,1 at the ends of the curve.

As described above, by making the minimum bending radius (=Rd,1) of the die shoulder 9 smaller than the bending radius (=Rp) of the punch shoulder 5, it is possible to restrain the material movement in the die shoulder 9 in the press forming process, and to strongly pull the material by that amount from the side of the top portion 3 to the side of the flange portion 11 in the press forming process. As a result, the fracture of the flange portion 11 and the wrinkles of the top portion 3 and the punch shoulder 5 in the curved portion are further controlled.

In the above description, the bending radius of the die shoulder 9 is changed as illustrated in FIG. 1. However, in the press forming part according to the present invention, as in a press forming part 21 illustrated as an example in FIG. 3, in addition to a bending radius of a die shoulder 29 being increased from end sides toward a middle portion of a curve, a portion 37 of shape that restrains rotational motion, which restrains a rotational motion of a blank in a horizontal plane parallel to a top portion 23 in a press forming process, may be further formed on the top portion 23 on an end side of a curved portion 33 and in a straight portion 35.

The portion 37 of shape that restrains rotational motion has a bent shape formed between a side wall portion 39 continuous on an opposite side of a side wall portion 27 of the straight portion 35 and the top portion 23.

As described above, by forming the portion 37 of shape that restrains rotational motion in the press forming process, it is possible to move the material from the top portion 23 on the end side of the curve and in the straight portion 35 to a flange portion 31 in the middle portion of the curve via the die shoulder 29 while controlling the rotational motion of the blank in the horizontal plane parallel to the top portion 23 in the press forming process, and wrinkles of the top portion 23 and the punch shoulder 25 in the curved portion 33 are sufficiently controlled.

Figure 3:
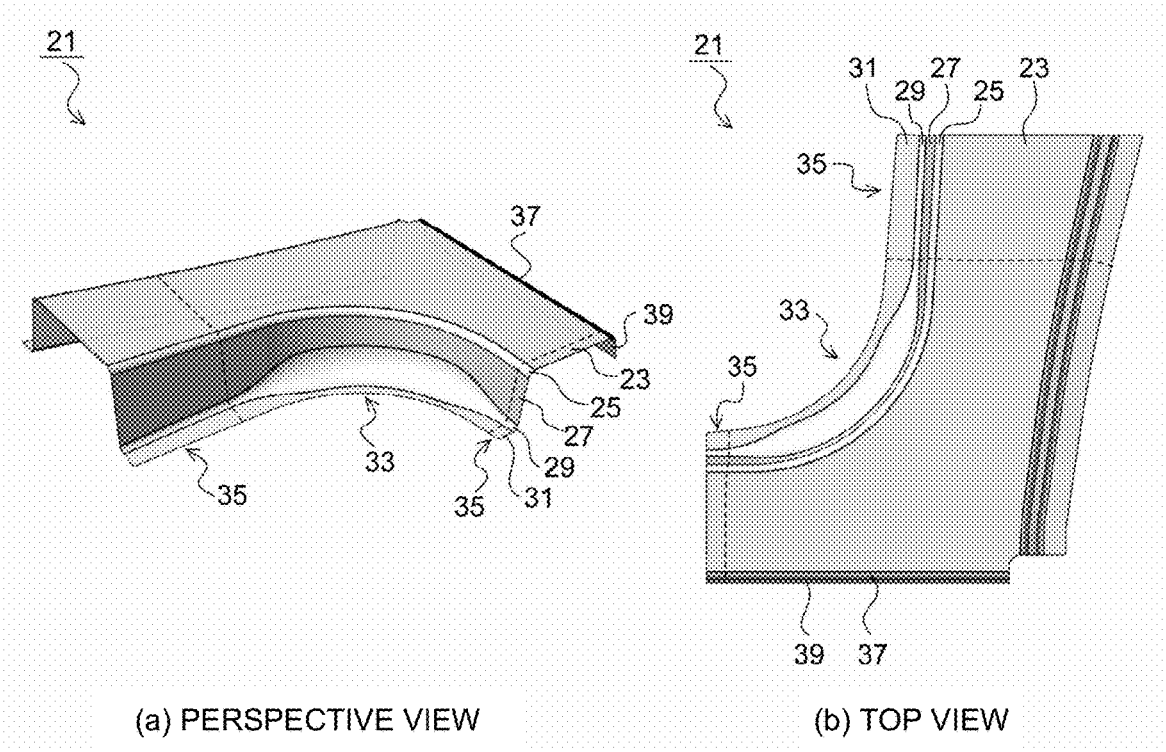
FIG. 3 is a view illustrating an example of a press forming part according to the embodiment of the present invention in which press forming part a bent shape that restrains a rotational motion of a blank in a horizontal plane parallel to a top portion in the press forming process is formed by a side wall portion formed on an end side of a curved portion.
Figure 4:
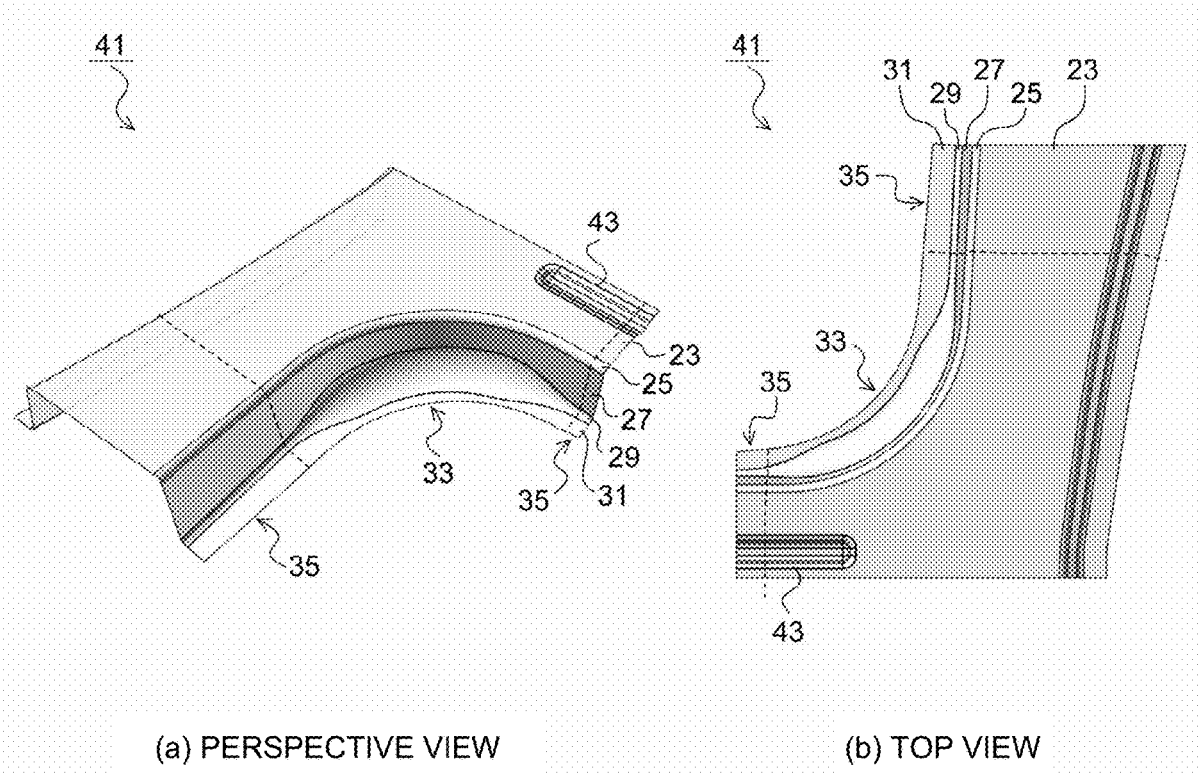
FIG. 4 is a view illustrating another example of a press forming part according to the embodiment of the present invention in which press forming part a bead shape that restrains a rotational motion of a blank in the horizontal plane parallel to the top portion in the press forming process is formed.

Note that in the present invention, the portion 37 of shape that restrains rotational motion does not necessarily have the shape illustrated in FIG. 3, and may have any shape as long as the rotational motion of the blank in the horizontal plane parallel to the top portion 23 can be restrained in the press forming process, for example, as a bead-shaped portion 43 of shape that restrains rotational motion formed on a top portion 23 of a press forming part 41 illustrated as an example in FIG. 4. Then, the bead shape formed on the top portion 23 is not limited to a recessed shape such as that of the portion 43 of shape that restrains rotational motion, and may be a protrusive shape.

In addition, the portion 37 of shape that restrains rotational motion illustrated in FIG. 3 and the portion 43 of shape that restrains rotational motion illustrated in FIG. 4 are formed from the end of the curved portion 33 to the straight portion 35. However, with respect to a position and a range in which the portion of shape that restrains rotational motion is formed, being in a portion corresponding to only the end of the curved portion 33 or a portion corresponding to only the straight portion 35 is not excluded.

Figure 5:
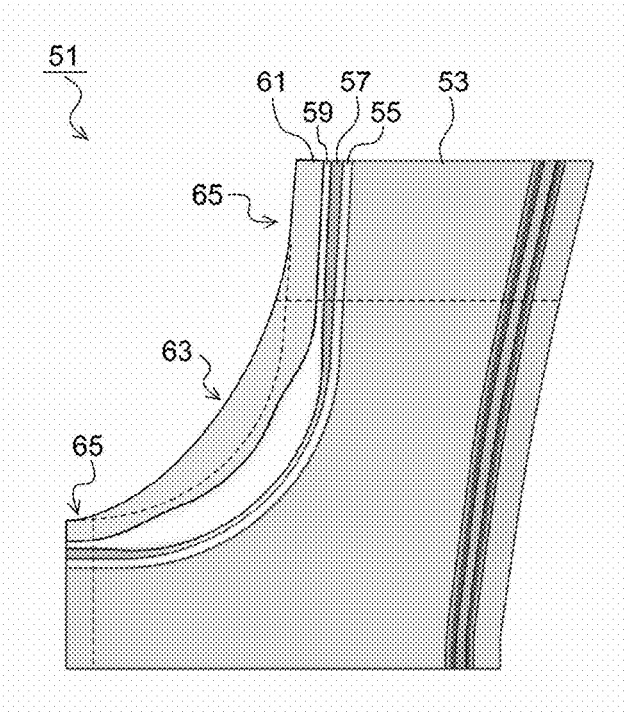
FIG. 5 is a view illustrating an example of a press forming part according to the embodiment of the present invention in which press forming part a flange width of a flange portion in a middle portion of a curve is increased.

Furthermore, in the press forming part according to the present invention, in addition to the bending radius of the die shoulder described above, a flange width of a flange portion 61 of a curved portion 63 may be larger in a middle portion than on end sides of a curve as in a press forming part 51 illustrated as an example in FIG. 5.

Figure 6:
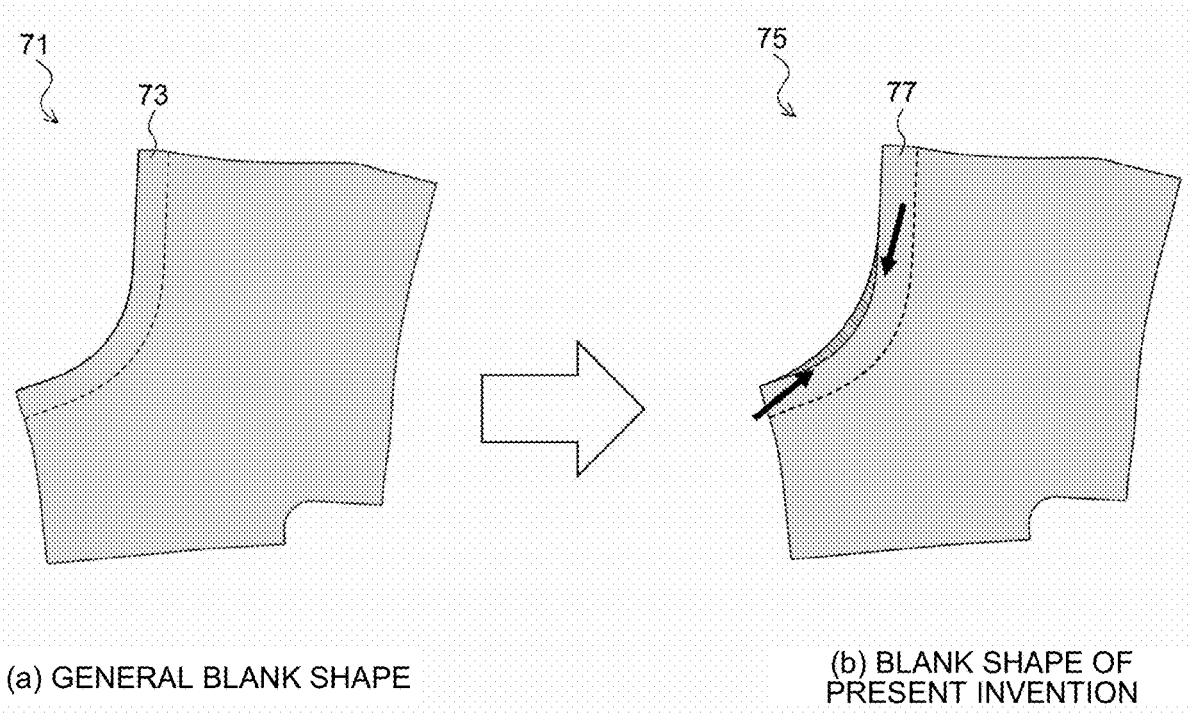
FIG. 6 is a view for describing a reason why a fracture is controlled in a press forming process of the press forming part according to the embodiment of the present invention in which press forming part the flange width of the flange portion in the middle portion of the curve is increased.

Effects acquired by the press forming part 51 illustrated in FIG. 5 are as follows. For example, as illustrated in FIG. 6(*a*), the press forming part 1 described above is acquired by press forming using a blank 71 having a shape that becomes a shape of the press forming part 1 when press formed. In this case, a flange equivalent portion 73 in the blank 71 becomes the flange portion 11 of the press forming part 1 (FIG. 1).

On the other hand, as illustrated in FIG. 6(*b*), the press forming part 51 illustrated in FIG. 5 is press formed by utilization of a blank 75 in which an excess material (hatched region in the drawing) of a flange equivalent portion 77 corresponding to the flange portion 61 is increased.

When the press forming part 51 is press formed by utilization of such a blank 75, since a material of the flange portion 61 in the curved portion 63 is less likely to stretch, a material insufficient for forming the flange portion 61 is pulled from a side of a top portion 53 via a punch shoulder 55 and a side wall portion 57. As a result, the material toward the middle portion of the curve in the curved portion 63 increases, and a fracture of the flange portion 61 is further controlled.

As in the press forming part 51 illustrated in FIG. 5, in a case where the flange width of the flange portion 61 in the curved portion 63 is made larger in the middle portion than on the end sides of the curve, the maximum flange width in the middle portion of the curve is preferably 1.1 to 1.5 times as large as the flange width on the end sides.

When the flange width in the middle portion of the curve is less than 1.1 times as large, force of pulling the material from the top portion 53 toward a side of the flange portion 61 in the press forming process does not increase much. In addition, when the flange width in the middle portion of the curve is larger than 1.5 times, the flange width of the flange portion 61 is too large and becomes an obstacle when being joined to another part. Thus, it is necessary to cut off the flange portion 61 in a subsequent step in such a manner that the flange width becomes narrow, the number of work processes increases, and a yield rate decreases.

Note that the press forming part 1 according to the embodiment of the present invention includes the straight portions 15 extending from both ends of the curve of the curved portion 13, for example, as illustrated in FIG. 1. However, the present invention may be a press forming part having only a curved portion or a press forming part having a straight portion extending from only one end of a curve, and presence or absence of the straight portion does not matter.

In addition, the bending radius of the die shoulder 9 is increased from both end sides toward the middle portion of the curve in the press forming part 1. However, a press forming part according to the present invention may become larger from any one end side of a curve toward a middle portion.

Note that although not being specifically limited in terms of a type of a metal sheet to be a raw material of the blank used for press forming thereof, the press forming part according to the present invention can be preferably applied in a case where a metal sheet having low ductility is used. Specifically, a metal sheet having tensile strength of a 440 MPa-grade or more and a 1600 MPa-grade or less and having a thickness of 0.5 mm or more and 3.6 mm or less is preferable.

A metal sheet having the tensile strength of less than the 440 MPa-grade has high ductility, whereby the fracture due to the stretch flange deformation is hardly generated, and there are few advantages of using the present invention. However, even a metal sheet having tensile strength of less than the 440 MPa-grade is preferably used for a press forming part of the present invention when a part shape is difficult to be press formed. Although there is not specifically an upper limit in the tensile strength, since a metal sheet exceeding the 1600 MPa-grade has poor ductility, a fracture in a punch shoulder and a die shoulder becomes likely to be generated and press forming becomes difficult.

Note that the press forming part according to the present invention can be preferably applied as automotive parts having an L-shaped, T-shaped, Y-shaped, or S-shaped portion curved in a top view, and a fracture and wrinkles are controlled in a press forming process of these automotive parts. Specific examples include an A pillar lower or the like having an L-shaped portion, a B pillar or the like having a T-shaped portion, and a rear side member or the like having an S-shaped portion.

Examples

A specific press forming experiment has been performed on the effects of the press forming part according to the present invention, and a description thereof will be made in the following.

In the press forming experiment, a steel sheet having a mechanical property of material illustrated in Table 1 was used as a blank, and the press forming part 1 (FIG. 1), the press forming part 21 (FIG. 3), the press forming part 41 (FIG. 4), and the press forming part 51 (FIG. 5) described in the above-described embodiment were used as objects to be formed, and crash forming was performed in an invention example.

A radius of the curve of the curved portion in the middle in a height direction of the side wall portion of each of the press forming parts was set to 153 mm, a bending radius of the punch shoulder in the curved portion was set to 7 mm, the smallest bending radius of the die shoulder was set to 6 mm, a flange width of the flange portion was set to 25 mm, and a side wall height in a press forming direction of the side wall portion was set to 60 mm. Furthermore, in a case where the flange width of the flange portion 11 in the press forming part 1 was made larger in the middle portion than on the end sides, the flange width of the flange portion 61 in the middle portion of the curve was set to be 1.5 times as large as the flange width on the end sides of the curve (=25 mm).

TABLE 1

| Thickness/mm | Yield strength/MPa | Tensile strength/MPa | Stretch/% |
|---|---|---|---|
| 1.6 | 880 | 1210 | 13 |

In the press forming experiment, a ratio of the bending radius Rd of the die shoulder in the press forming part to be an object to be formed was changed. Here, the ratio of the bending radius Rd of the die shoulder is a ratio between the largest bending radius and the smallest bending radius in a ridge direction along the curve of the die shoulder.

Figure 7:
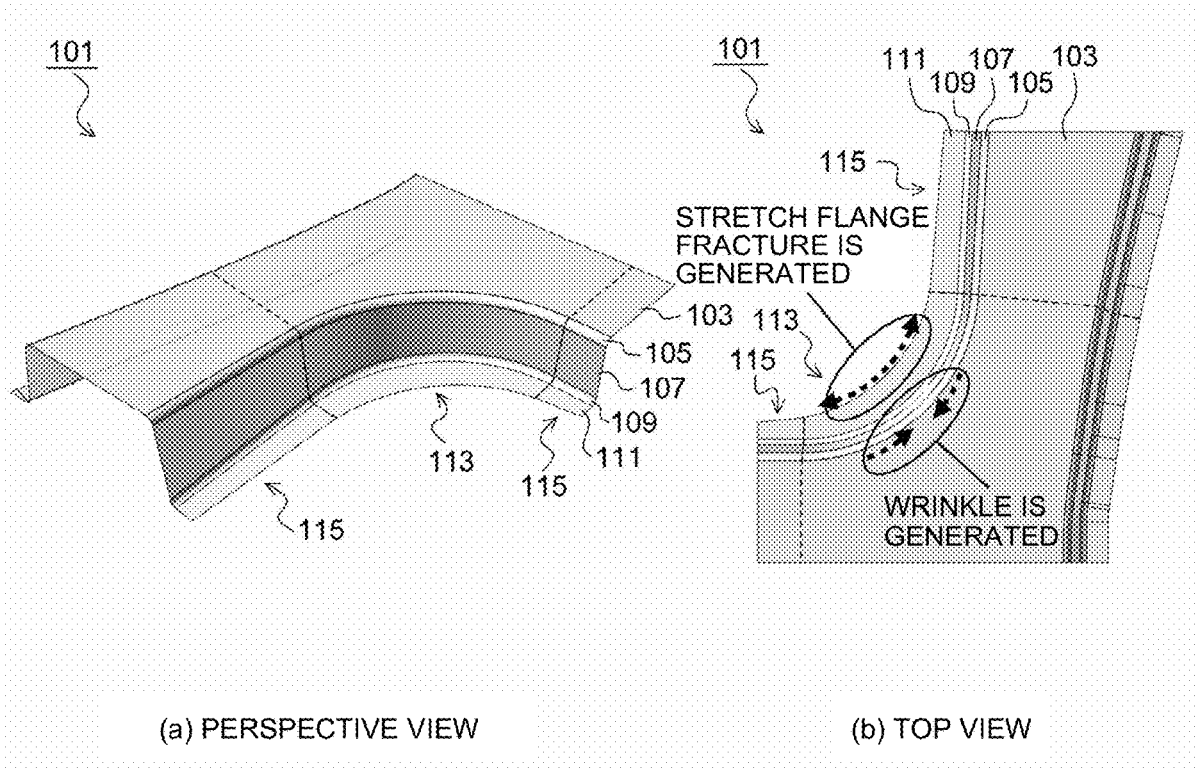
FIG. 7 is a view for describing a mechanism in which a fracture and wrinkles are generated in a press forming process of a press forming part having a portion curved in a recessed manner in a top view.
Figure 8:
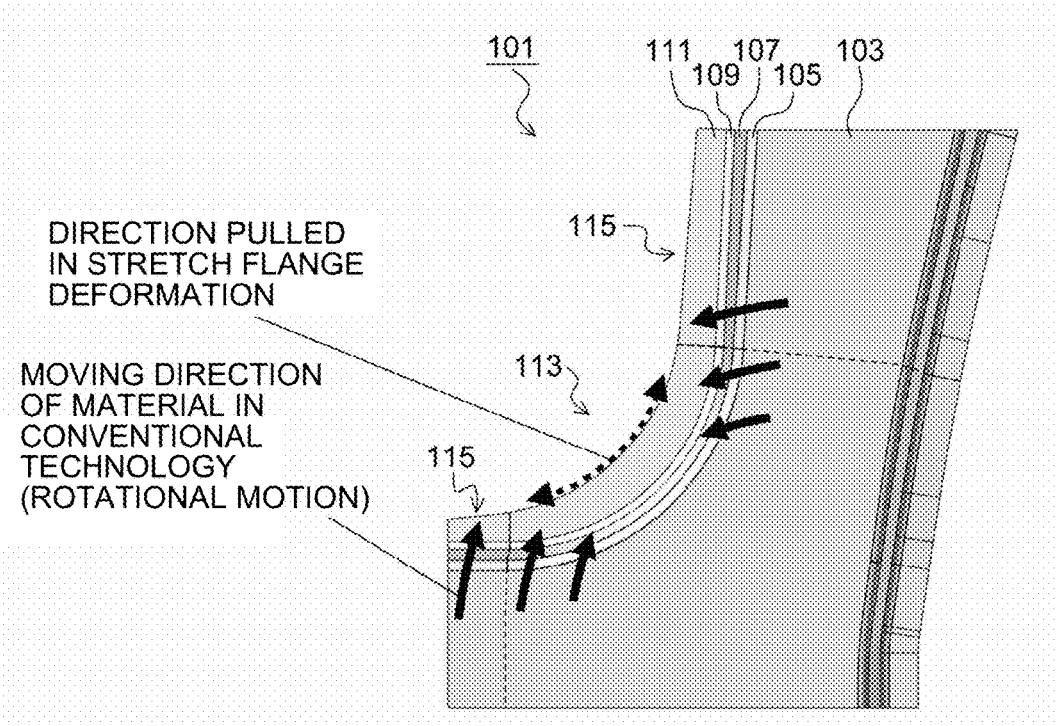
FIG. 8 is a view for describing a mechanism in which a fracture is generated in the press forming process of the press forming part curved in the recessed manner in the top view.
Figure 9:
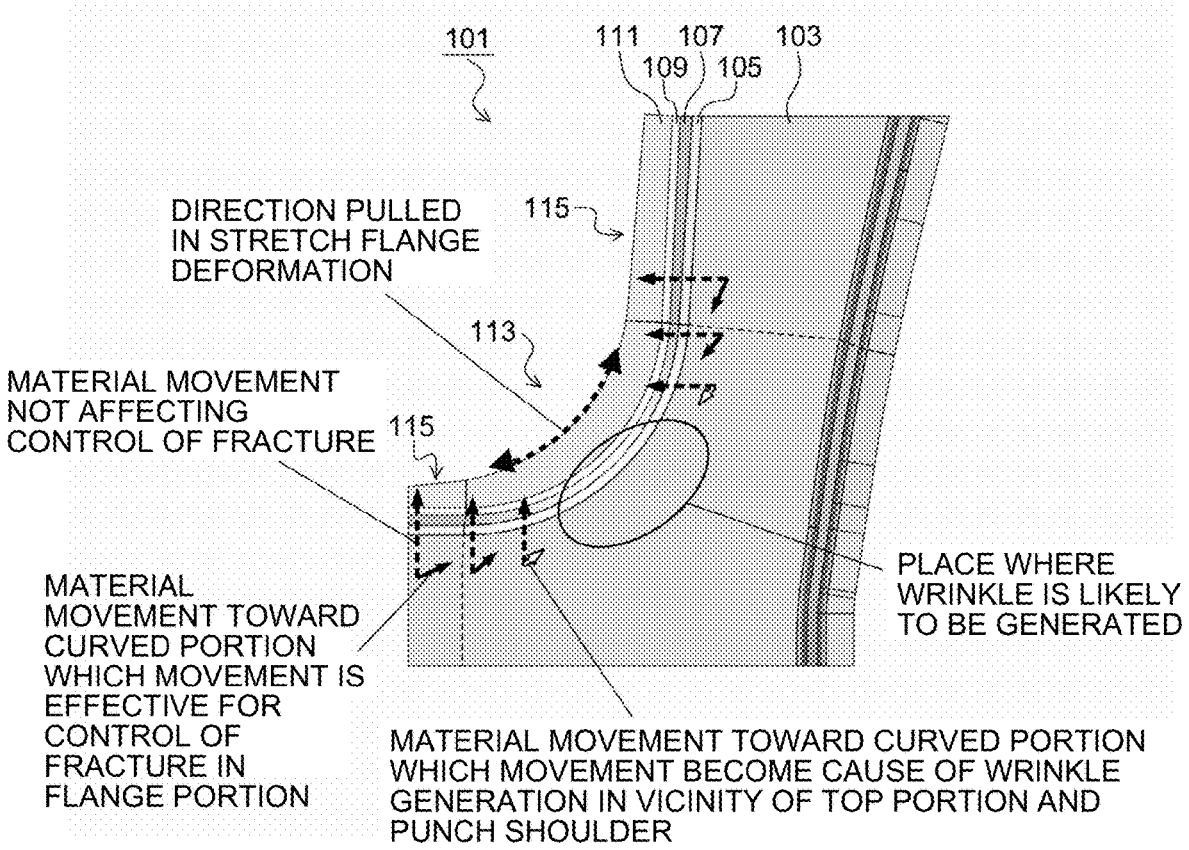
FIG. 9 is a view for describing a material movement in the press forming process of the press forming part curved in the recessed manner in the top view.

Furthermore, in the press forming experiment, as a comparative object, a press forming part 101 acquired by press forming in a state in which a portion corresponding to a top portion 103 of the press forming part 101 illustrated in FIG. 7 is pressed by a pad and a rotational motion of a blank in a horizontal plane parallel to the top portion 103 is allowed in accordance with the method disclosed in Patent Literature 1 was set as a conventional example.

In the conventional example, a curvature radius of a curve of a curved portion 113, a bending radius of a punch shoulder 105, and a side wall height of a side wall portion 107 were set to be the same as those of the press forming part according to the invention example. Furthermore, a bending radius of a die shoulder 109 was set to be constant (=6 mm) in a direction along the curve as the smallest bending radius of the die shoulder.

Then, a fracture and wrinkles in each of the press forming parts according to the invention examples and the conventional example were evaluated. In the evaluation of the fracture, a thickness reduction ratio in which a difference between a thickness of a blank and a thickness of a flange portion tip (such as a C portion illustrated in FIG. 2) of the deepest bottom portion of a recessed portion in a curved portion was divided by the thickness of the blank was calculated, and it was evaluated that fracture control was better as a value thereof became smaller. On the other hand, in the evaluation of the wrinkles, sensory evaluation was performed on a top portion and a punch shoulder in the curved portion by visual inspection, a case where there were significant wrinkles being evaluated as "X", a case where there were minute wrinkles that could be visually confirmed but were allowable in terms of part performance being evaluated as "Δ", and a case where wrinkles could not be visually confirmed being evaluated as "○". Results of the evaluation of the fracture and wrinkles for each of the press forming parts were illustrated in Table 2 and Table 3.

TABLE 2

| No. | Conventional example | First invention example | Second invention example | Third invention example |
|---|---|---|---|---|
| Content | Make bending radius of die shoulder constant | Increase bending radius $R_d$ of die shoulder in curved portion | ← | ← |
| Ratio of bending radius $R_d$ of die shoulder | 1.0 | 1.1 | 1.5 | 2.0 |
| Evaluation of fracture (thickness reduction ratio (%)) | 18 | 17 | 14 | 12 |
| Sensory evaluation of wrinkle | Δ | ○ | ○ | ○ |

TABLE 3

| No. | Fourth invention example | Fifth invention example | Sixth invention example | Seventh invention example | Comparative example |
|---|---|---|---|---|---|
| Content | Increase bending radius $R_d$ of die shoulder in curved portion + restrain rotational motion of blank (bent shape) | Increase bending radius $R_d$ of die shoulder in curved portion + restrain rotational motion of blank (bead shape) | Give excess material to blank of first invention example | Give excess material to blank of second invention example | Uniformly increase bending radius $R_d$ of die shoulder of entire part (1.5 time) |
| Ratio of bending radius $R_d$ of die shoulder | 1.5 | ← | 1.1 | 1.5 | ← |
| Evaluation of fracture (thickness reduction ratio (%)) | 15 | 14 | 8 | 9 | 9 |
| Sensory evaluation of wrinkle | ○ | ○ | ○ | ○ | X |

In the conventional example, the thickness reduction ratio was large and was 18%, and fine wrinkles were generated.

In a first invention example, the press forming part 1 (FIG. 1) is set as an object to be formed, and the bending radius Rd of the die shoulder 9 is increased at a ratio of 1.1 from the end sides of the curve toward the middle portion. As illustrated in Table 2, the thickness reduction ratio was 17% and was reduced as compared with the conventional example, and generation of wrinkles was not observed.

In a second invention example, the press forming part 1 is set as an object to be formed, and a ratio of the bending radius Rd of the die shoulder 9 is set to 1.5, which is larger than that in the first invention example. As illustrated in Table 2, the thickness reduction ratio was 14% and was reduced as compared with the first invention example, and generation of wrinkles was not observed.

In a third invention example, the press forming part 1 is set as an object to be formed, and a ratio of the bending radius Rd of the die shoulder 9 is set to 2.0, which is larger than that in the second invention example. As illustrated in Table 2, the thickness reduction ratio was 12% and was further reduced as compared with the second invention example, and generation of wrinkles was not observed.

In a fourth invention example, the press forming part 21 (FIG. 3) is set as an object to be formed, a ratio of the bending radius Rd of the die shoulder 29 is set to 1.5, and the bent-shaped portion 37 of shape that restrains rotational motion is formed between the top portion 23 and the side wall portion 39. As illustrated in Table 3, the thickness reduction ratio was 15% and was reduced as compared with the conventional example, and generation of wrinkles was not observed.

In a fifth invention example, the press forming part 41 (FIG. 4) is set as an object to be formed, a ratio of the bending radius Rd of the die shoulder 29 is made equal to that in the fourth invention example, and the bead-shaped portion 43 of shape that restrains rotational motion is formed from the end side of the curve to the straight portion 15 on the top portion 23. As illustrated in Table 3, the thickness reduction ratio was 14% and was reduced as compared with the conventional example, and generation of wrinkles was not observed.

In a sixth invention example, the press forming part 51 (FIG. 5) is set as an object to be formed, and the blank 75 having a shape in which an excess material is given to the flange equivalent portion 77 (see FIG. 6) is used. Similarly to the first invention example, a ratio of the bending radius Rd of a die shoulder 59 is set to 1.1, and the flange width of the flange portion 61 in the middle portion of the curved portion 63 is set to be 1.5 times as large as the flange width on the end sides of the curve (=25 mm). As illustrated in Table 3, the thickness reduction ratio was 8% and was reduced as compared with the first invention example, and generation of wrinkles was not observed.

In a seventh invention example, the press forming part 51 (FIG. 5) is set as an object to be formed, and the blank 75 having a shape in which an excess material is given to the flange equivalent portion 77 (see FIG. 6) is used. Similarly to the second invention example, a ratio of the bending radius Rd of the die shoulder 59 is set to 1.5, and the flange width of the flange portion 61 in the middle portion of the curved portion 63 is set to be 1.5 times as large as the flange width on the end sides of the curve (=25 mm). As illustrated in Table 3, the thickness reduction ratio was 9% and was reduced as compared with the second invention example, and generation of wrinkles was not observed.

Note that an example of a press forming part 101 in which a bending radius of a die shoulder 109 is uniformly made larger than that of the conventional example (fracture) and wrinkles is illustrated in Table 3 as a comparative example. In the comparative example, a bending radius of an entire die shoulder 109 of the conventional example was increased by 1.5 times and was made constant at 9.0 mm. As a result, although the thickness reduction ratio was 9% and was well, significant wrinkles were generated, which was a problem.

As described above, it has been demonstrated that a fracture of a flange portion in a curved portion is controlled and wrinkles of a top portion and a punch shoulder in the curved portion are controlled in the press forming part according to the present invention in a press forming process thereof.

INDUSTRIAL APPLICABILITY

According to the present invention, it is possible to provide a press forming part which includes a top portion, a side wall portion, and a flange portion and is curved in a recessed manner in a top view, and in which a fracture in the flange portion, in which a stretch flange deformation is generated, is controlled and wrinkles of the top portion on a side of the flange portion and a punch shoulder are controlled.

REFERENCE SIGNS LIST

1 PRESS FORMING PART
3 TOP PORTION
5 PUNCH SHOULDER
7 SIDE WALL PORTION
9 DIE SHOULDER
11 FLANGE PORTION
13 CURVED PORTION
15 STRAIGHT PORTION
21 PRESS FORMING PART
23 TOP PORTION
25 PUNCH SHOULDER
27 SIDE WALL PORTION
29 DIE SHOULDER
31 FLANGE PORTION
33 CURVED PORTION
35 STRAIGHT PORTION
37 PORTION OF SHAPE THAT RESTRAINS ROTATIONAL MOTION
39 SIDE WALL PORTION
41 PRESS FORMING PART
43 PORTION OF SHAPE THAT RESTRAINS ROTATIONAL MOTION
51 PRESS FORMING PART
53 TOP PORTION
55 PUNCH SHOULDER
57 SIDE WALL PORTION
59 DIE SHOULDER
61 FLANGE PORTION
65 STRAIGHT PORTION
63 CURVED PORTION
71 BLANK
73 FLANGE EQUIVALENT PORTION
75 BLANK
77 FLANGE EQUIVALENT PORTION
101 PRESS FORMING PART
103 TOP PORTION
105 PUNCH SHOULDER
107 SIDE WALL PORTION
109 DIE SHOULDER
111 FLANGE PORTION
113 CURVED PORTION
115 STRAIGHT PORTION

The invention claimed is:

1. A press forming part, which is essentially L-shaped in a top view, comprising:
- a top portion;
- a side wall portion continuous from the top portion via a punch shoulder; and
- a flange portion continuous from the side wall portion via a die shoulder, the press forming part having a curved portion curved in a recessed manner in the top view, wherein
- a stretch flange deformation generates at the flange portion in the curved portion when the press forming part is brought into a target shape, and
- a bending radius of the die shoulder in the curved portion is increased from an end side toward a middle portion of the curve.

2. The press forming part according to claim 1, wherein a minimum bending radius of the die shoulder is smaller than a bending radius of the punch shoulder.

3. The press forming part according to claim 1, wherein a portion of shape that restrains rotational motion, which restrains a rotational motion of a blank in a press forming process, is formed on the top portion on the end side of the curve.

4. The press forming part according to claim 2, wherein a portion of shape that restrains rotational motion, which restrains a rotational motion of a blank in a press forming process, is formed on the top portion on the end side of the curve.

5. The press forming part according to claim 1, wherein a width of the flange portion in the curved portion is larger in the middle portion than on the end side of the curve.

6. The press forming part according to claim 2, wherein a width of the flange portion in the curved portion is larger in the middle portion than on the end side of the curve.

7. The press forming part according to claim 3, wherein a width of the flange portion in the curved portion is larger in the middle portion than on the end side of the curve.

8. The press forming part according to claim 4, wherein a width of the flange portion in the curved portion is larger in the middle portion than on the end side of the curve.

9. The press forming part according to claim 1, wherein the press forming is performed by utilization of a metal sheet having tensile strength of a 440 MPa-grade to a 1600 MPa-grade.

10. The press forming part according to claim 2, wherein the press forming is performed by utilization of a metal sheet having tensile strength of a 440 MPa-grade to a 1600 MPa-grade.

11. The press forming part according to claim 3, wherein the press forming is performed by utilization of a metal sheet having tensile strength of a 440 MPa-grade to a 1600 MPa-grade.

12. The press forming part according to claim 4, wherein the press forming is performed by utilization of a metal sheet having tensile strength of a 440 MPa-grade to a 1600 MPa-grade.

13. The press forming part according to claim 5, wherein the press forming is performed by utilization of a metal sheet having tensile strength of a 440 MPa-grade to a 1600 MPa-grade.

14. The press forming part according to claim 6, wherein the press forming is performed by utilization of a metal sheet having tensile strength of a 440 MPa-grade to a 1600 MPa-grade.

15. The press forming part according to claim 7, wherein the press forming is performed by utilization of a metal sheet having tensile strength of a 440 MPa-grade to a 1600 MPa-grade.

16. The press forming part according to claim 8, wherein the press forming is performed by utilization of a metal sheet having tensile strength of a 440 MPa-grade to a 1600 MPa-grade.

17. The press forming part according to claim 2, wherein the minimum bending radius of the die shoulder is smaller than a bending radius of the punch shoulder in the curved portion, and the bending radius of the punch shoulder in the curved portion is constant from the middle portion of the curve to both end sides of the curve.

* * * * *